US005742978A

United States Patent [19]

Vetter

[11] Patent Number: 5,742,978

[45] Date of Patent: Apr. 28, 1998

[54] CONCEALED SNUBBER

[75] Inventor: Gregory J. Vetter, Owatonna, Minn.

[73] Assignee: Truth Hardware Corporation, Owatonna, Minn.

[21] Appl. No.: 694,500

[22] Filed: Aug. 7, 1996

[51] Int. Cl.[6] ..... E06B 3/58

[52] U.S. Cl. ..... 16/220; 49/506; 292/DIG. 55; 72/379.2

[58] Field of Search ..... 16/82, 404, 220; 49/406; 292/DIG. 55; 72/379.2

[56] References Cited

U.S. PATENT DOCUMENTS

| | | | |
|---|---|---|---|
| 245,075 | 9/1881 | Booth | 49/406 |
| 1,142,029 | 6/1915 | Champs | 16/220 |
| 2,284,436 | 5/1942 | Lundgren | 16/197 |
| 2,461,767 | 2/1949 | Peyton | 16/404 |
| 4,493,128 | 1/1985 | Corry | 16/193 |

OTHER PUBLICATIONS

Truth Hardware Brochure "Snubbers", pp. 1.7–1.7a (1993).

*Primary Examiner*—A. L. Pitts
*Assistant Examiner*—Mark Williams
*Attorney, Agent, or Firm*—Wood, Phillips, VanSanten, Clark & Mortimer

[57] ABSTRACT

A window snubber including a flat metal base having means adapted for securing the base against a window frame and/or a window sash, a metal snubber flange integral with the base and extending substantially upright therefrom, and supporting wings integrally formed with the base and the flange, and a method of manufacturing thereof. The flange has a side adapted to engage a window sash and/or a corresponding side of a second window snubber, when the sash is closed relative to a window frame. The supporting wings extend from opposite sides of the flange to integral connections to the base. The flange extends upright substantially along a plane with the flange side adapted to engage a window sash and/or second snubber facing one side relative to the plane, and the wing integral connections to the base extend on the other side relative to the plane. A portion on the top of the flange is bent into the other side relative to the plane.

14 Claims, 3 Drawing Sheets

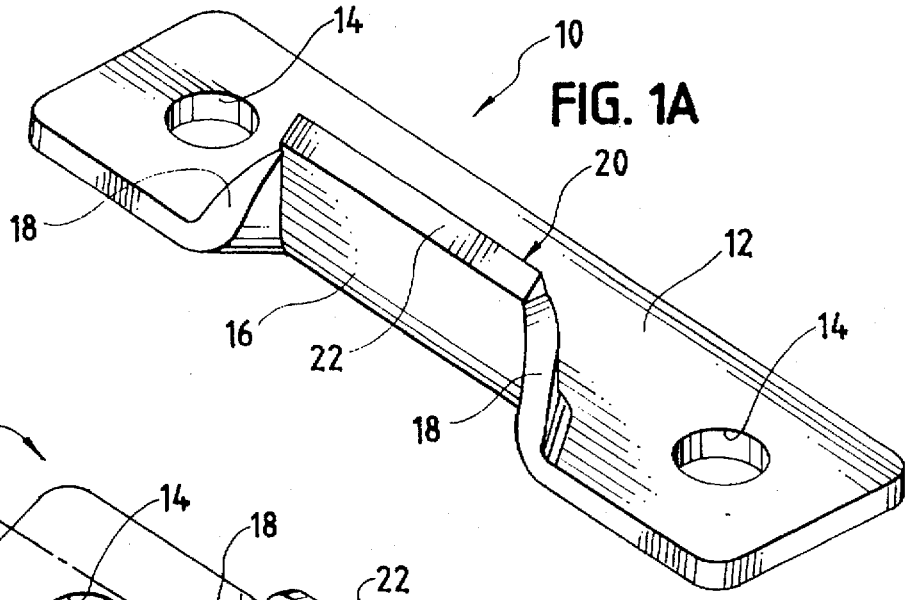
FIG. 1A
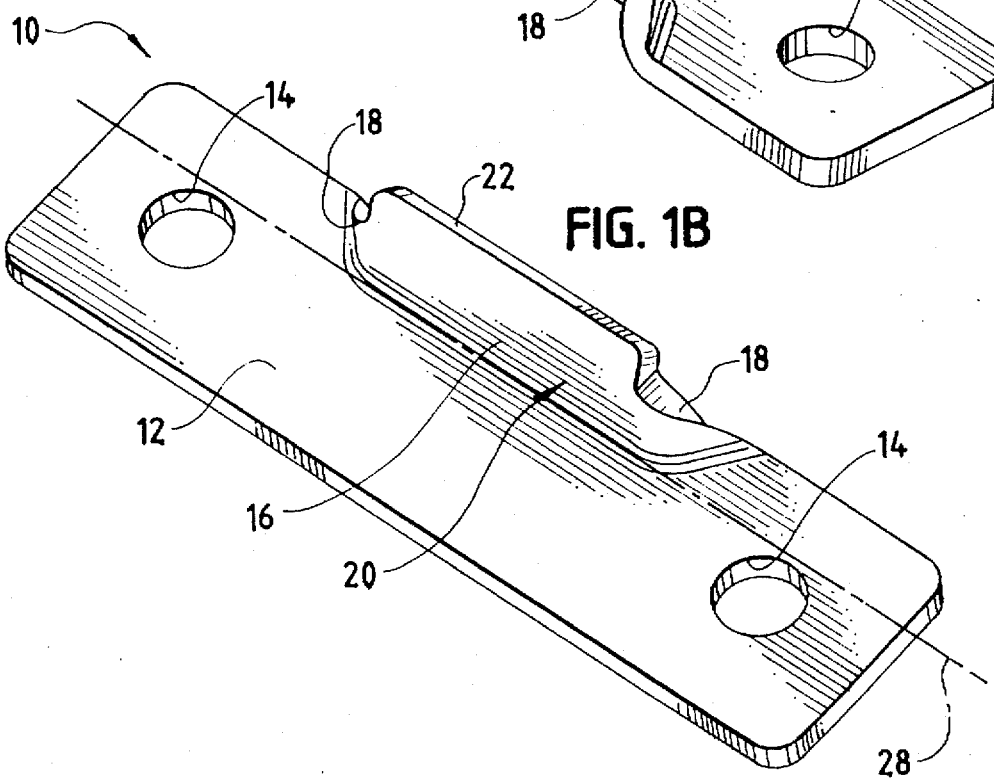
FIG. 1B
FIG. 2
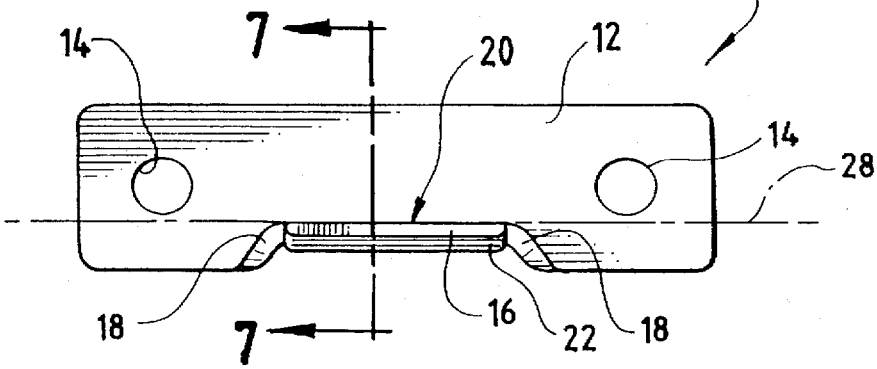

CONCEALED SNUBBER

BACKGROUND OF THE INVENTION

1. Technical Field

The present invention is directed toward a window snubber, and more particularly toward a concealed window snubber.

2. Background Art

Window snubbers are old in the art, and generally include a substantially flat metal base and a tab extending substantially upright from and integral with the base. The tab has a side adapted to engage either a window sash or a corresponding side of a second snubber, depending on whether the snubber is exposed or concealed. The lateral sides of the tab are generally perpendicular with the surface of the base, and form generally a right angle when the snubber is viewed from the front or rear.

In the case of a concealed prior art snubber, the tab extends substantially upright from the base generally along a bend line which is recessed from a side edge of the base. Portions of the base adjacent the lateral sides of the tab are normally cut-out, and generally define the beginning and end of the bend line at the integral connection of the tab and base.

With many prior art snubbers, strength is a concern. When pressure is applied to the engaging side of the tab, the strength of the snubber depends entirely upon the rigid strength of the material at the bend line defining the integral connection of the tab and base.

Longevity is also a concern with many prior art snubbers. As the window sash, or corresponding snubber, continuously engages the engaging side of the tab, the integral connection of the tab with the base weakens over time. As this portion of the snubber weakens, the window may begin to bow and/or the seals at the bottom and top rails may open when the sash is in the closed position relative to the frame. In time, the tab may completely brake off and the snubber will have to be replaced.

The present invention is directed toward overcoming one or more of the problems discussed above.

SUMMARY OF THE INVENTION

In one aspect of the present invention, a window snubber is provided for maintaining a window sash in proper orientation relative to a window frame when closed relative thereto. The window snubber includes a flat metal base including means adapted for securing the base against a window frame, a metal snubber flange integral with the base and extending substantially upright therefrom, the flange having a side adapted to engage a window sash when closed relative to a window frame, and supporting wings integrally formed with the base and the flange, the supporting wings extending from opposite sides of the flange to integral connections to the base.

In preferred forms of this aspect of the present invention, the flange extends upright substantially along a plane with the flange side adapted to engage a window sash facing one side relative to the plane, and the wing integral connections to the base extending on the other side relative to the plane.

In still other preferred forms of this aspect of the present invention, a portion on the top of the flange is bent into the other side relative to the plane, and engagement of the flange by a window sash applies a compressive force to the support wings.

In another aspect of the present invention, a window snubber system is provided for maintaining a window sash in proper orientation relative to a window frame when closed relative thereto. The window snubber system includes first and second snubbers, each including a flat metal base having means adapted for securing the base against a window frame and/or a window sash, a metal snubber flange integral with the base and extending substantially upright therefrom, and supporting wings integrally formed with the base and the flange, the wings extending from opposite sides of the flange to integral connections to the base. Each of the flanges on the first and second snubbers has a side adapted to engage a corresponding side on the other of the flanges when a window sash is closed relative to a window frame.

In preferred forms of this aspect of the present invention, each of the flanges extends upright substantially along a plane with the engaging side facing one side relative to plane, and each of the wing integral connections to the base extending on the other side relative to the plane.

In other preferred forms of this aspect of the present invention, a portion on the top of each of the flanges is bent into the other side relative to the plane, and engagement of the flanges by each other applies a compressive force to each of the supporting wings.

In another aspect of the present invention, a method of making a window snubber for use in maintaining a window sash in proper orientation to a window frame when closed relative thereto is provided. The method includes the steps of providing a substantially flat metal workpiece, and swaging a selected portion of the workpiece to define a flange bent upright from the remaining portion of the workpiece, the flange bend extending substantially along a line, wherein prior to swaging the flange defining selected portion is integrally connected to the workpiece both along the bend line and along at least a portion of lateral sides of the workpiece selected portion.

In preferred forms of this aspect of the present invention, the workpiece selected portion is substantially rectangular with the top side, bottom side, and lateral sides extending between the top and bottom sides, the bottom side corresponding substantially to the bend line and portions of the lateral sides being integrally connected to the remaining portion of the workpiece.

In other preferred forms of this aspect of the present invention, the swaging step causes non-elastic stretching of the workpiece to form supporting wings on the lateral sides of the selected portion, and also curves the flange adjacent the top side.

In other preferred forms of this aspect of the present invention, the method further includes the step of forming means adapted for securing the remaining portion of the workpiece against a window frame or window sash.

An object of the present invention is to provide an inexpensive and easy way to make window snubber able to withstand significant stresses repeatedly encountered over the many years of the life of a window.

BRIEF DESCRIPTION OF THE DRAWINGS

FIG. 1A is a perspective view of a preferred embodiment of the present invention;

FIG. 1B is a perspective view from the back of FIG. 1A;

FIG. 2 is a top view of the FIG. 1A embodiment;

DETAILED DESCRIPTION OF THE PREFERRED EMBODIMENT

Figure 3:
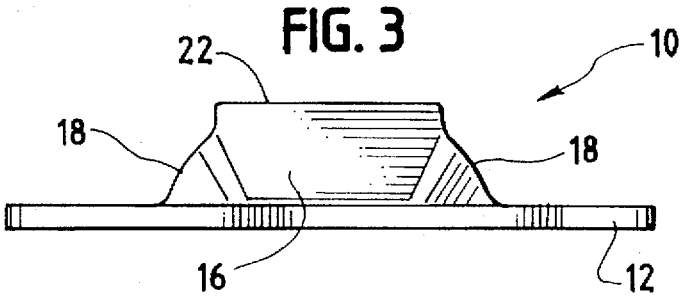
FIG. 3 is a back view of the FIG. 1A embodiment.
Figure 4:
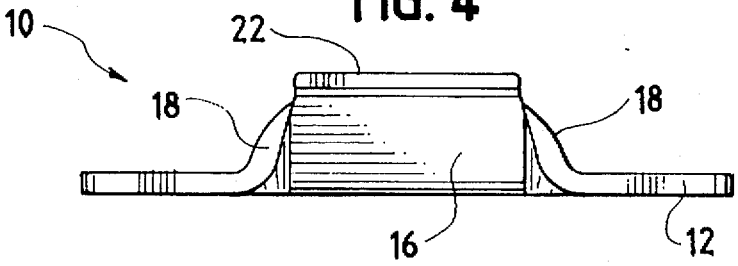
FIG. 4 is a front view of the FIG. 1A embodiment.

Referring to FIGS. 1A or 1B, a window snubber is generally indicated by 10. The window snubber 10 has a base 12 which includes means for attaching the window snubber 10 to either a window jamb or a window sash. In a preferred form of the invention, the snubber 10 is attached to the jamb and/or sash by screws extending through holes 14 formed at opposite ends of the base 12. The mounting of such a window snubber by screws is well known in the art, however, the present invention is not limited solely to mounting via screws.

It should be understood that though the description herein generally refers to casement windows, the present invention could also be used with a variety of different window types, including wide awning windows and double-hung windows, as well as windows made of a variety of different materials, such as wood or vinyl wrap windows. Specifically, the window snubber 10 of the present invention may be advantageously used to prevent the bowing and increase the negative air pressure rating of a variety of types of windows when in the closed position.

The window snubber 10, which will hereafter be described, is only one example of the type of snubber which would benefit from incorporating the present invention and method. Though the particular snubber structure such as disclosed herein may be advantageously used with the present invention, once a full understanding of the present invention is obtained, it should be recognized that still other snubber configurations could also be advantageously used with the present invention.

Referring to FIGS. 1A–4, window snubber 10 is comprised of a base 12 and a flange 16 which is integrally formed with the base 12 and extends substantially upright therefrom. Supporting wings 18 are disposed on lateral sides of the flange 16, and in a preferred form of the snubber 10 are integrally formed with the base 12 and the flange 16.

Figure 6:
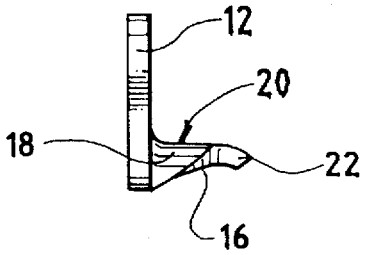
FIG. 6 is a side view of the FIG. 1A embodiment.
Figure 7:
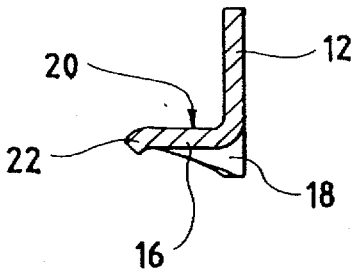
FIG. 7 is a cross-sectional view taken along line 7—7 of FIG. 2.

The flange 16 includes an engaging side 20, which is adapted to engage either a window sash or a corresponding side of a corresponding snubber, depending on whether the snubber is exposed or concealed, when a window sash is closed relative to a window frame. As best seen in FIGS. 6–7, a top portion 22 of the flange 16 is preferably bent at an angle away from the engaging side 20 of flange 16.

Figure 8:
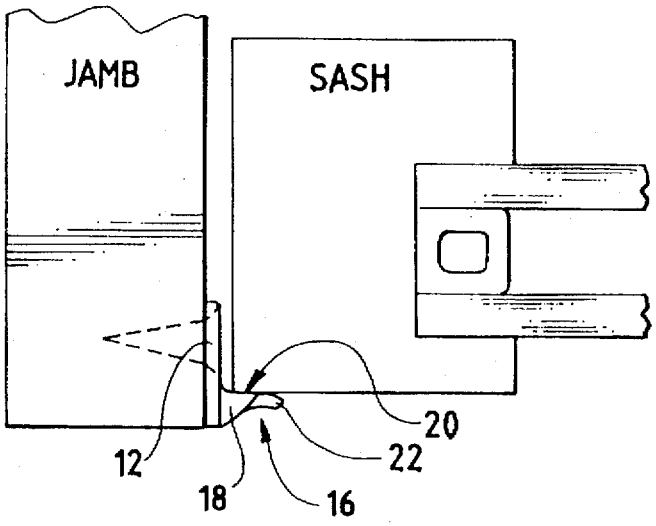
FIG. 8 is a top view of a window embodying a preferred form of the present invention.

FIG. 8 depicts a top view of a window embodying a preferred form of the snubber 10 utilized as an exposed snubber. The window snubber 10 is securely fastened to the window jamb by screws passing through the holes 14 formed in the base 12. It should be understood that any conventional means of mounting the snubber 10 to the jamb may be utilized without departing from the spirit and scope of the present invention.

The FIG. 8 embodiment depicts the sash being closed relative to the jamb. A side of the sash engages the engaging side 20 of flange 16 when the window sash is in this closed position. The pressure exerted by the sash on the engaging side 20 of flange 16 applies a compressive force to the supporting wings 18 located on either side of the flange 16. The supporting wings 18 extend from flange 16 on a side opposite the engaging side 20 of flange 16 to the base 12 and resist the compressive forces, thus preventing the window from bowing outwardly. For optimum performance with a tall casement window which has a tendency to bow outwardly at the center in the closed position, the window snubber 10 should be affixed at the center of the hinge side.

A PVC insert (not shown) may be added to the flange 16. A PVC insert would normally be used when the snubber 10 is utilized as an exposed snubber, and the sash has a cladded exterior.

Figure 9:
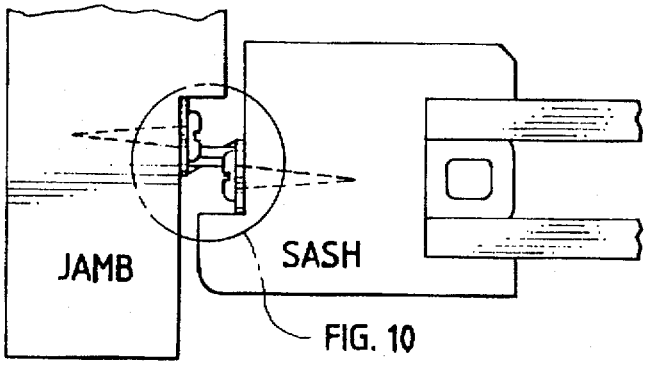
FIG. 9 is a top view of a window embodying another preferred form of the present invention.
Figure 10:
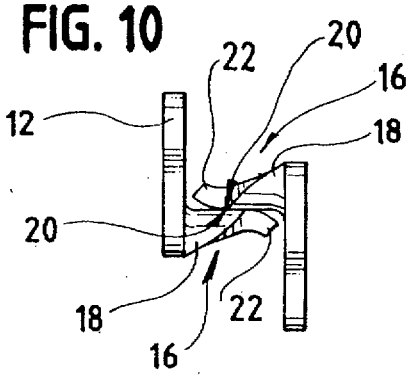
FIG. 10 is an exploded portion of FIG. 9 depicting engagement of the concealed snubbers when a window sash is closed relative to a window frame.

FIG. 9 depicts a top view of a window embodying a preferred form of the present invention utilized as a concealed snubber. Similar to FIG. 8, the snubbers are attached to the jamb and sash, respectively, via screws extending through holes 14 which are formed in the base 12. The exploded portion of FIG. 9 illustrates the engagement of the snubbers 10 when the sash is closed relative to the jamb (with the screws removed from the exploded portion). The snubbers 10 are of the same general construction as set forth in the previous description.

When the sash is moved to a closed position relative to the jamb, the engaging faces 20 of the corresponding snubbers 10 engage to prevent bowing of the window, and also to increase the negative air pressure rating of the window. In this particular utilization, the snubbers 10 are concealed from view when the sash is in its closed position relative to the jamb.

Engagement of the snubbers 10 at their engaging faces 20 of their respective flanges 16 produces a compression force on the supporting wings 18 of each snubber. The supporting wings 18 resist the compressive forces, thus preventing the window from bowing outwardly.

Figure 5:
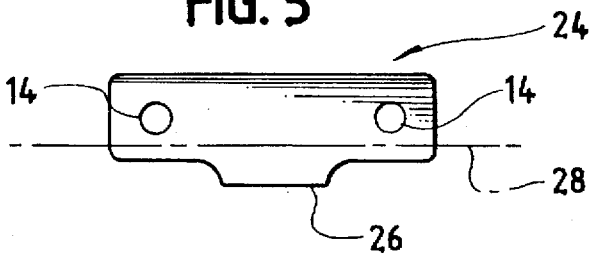
FIG. 5 is a top view of a preferred embodiment of a metal workpiece before swaging.

A method of making the window snubber 10, as previously set forth, will now be described. FIG. 5 illustrates a preferred form of a metal workpiece 24 before the workpiece 24 is formed into a corresponding snubber 10. In a preferred form, the workpiece 24 is comprised of heavy gauge steel and is generally rectangular in shape. However, it is to be understood that other similar metals and shapes of the workpiece can be utilized without departing from the spirit and scope of the present invention. In its finished form, the snubber 10 is preferably finished with a phosphate coated, electrostatically painted baked enamel finish which resists chipping and flaking. However, other types of finishes may also be utilized.

In forming the snubber 10 from the metal workpiece 24 shown in FIG. 5, the tab portion 26 is swaged to define flange 16, which in its finished form is bent upright from the remaining portion of the workpiece 24, which defines the base 12. Swaging the tab portion 26 defines generally a bend line 28 which is recessed from an edge of the metal workpiece 24. The bend line 28 in the finished product is clearly shown in FIGS. 1B and 2.

Swaging of the workpiece 24 in this manner so that the bend line 28 is recessed from an edge of the workpiece 24, allows supporting wings 18 to form on lateral sides of the flange 16. The supporting wings 18 are formed due to the non-elastic stretching of the workpiece 24 as it is swaged. The supporting wings 18 are formed such that they extend on the other side of the engaging side 20 of the flange 16, with the flange being formed due to the swaging of the tab portion 26. A top portion 22 of the flange 16 is then further bent away from the engaging side 20 of tab 16.

Still other aspects, objects and advantages of the present invention can be obtained from a study of the specification, the drawings, and the appended claims.

I claim:

1. A window snubber for maintaining a window sash in proper orientation relative to a window frame when closed relative thereto, comprising:

a flat metal base including securement means adapted for securing said base against a window frame;

a metal snubber flange integral with said base and extending substantially upright from said base, said flange having a side adapted to engage a window sash when closed relative to a window frame; and supporting wings integrally formed with said base and said flange, said wings extending from opposite sides of said flange to integral connections to said base.

2. The snubber of claim 1, whereby said flange extends upright substantially along a plane with said flange side adapted to engage a window sash facing one side relative to said plane, and said wing integral connections to said base extending on the other side relative to said plane.

3. The snubber of claim 2, further comprising a portion on the top of said flange bent into said other side relative to said plane.

4. The snubber of claim 1, whereby engagement of the flange by a window sash applies a compressive force to said support wings.

5. A method of making a window snubber for use in maintaining a window sash in proper orientation relative to a window frame when closed relative thereto, said method comprising the steps of:

providing a substantially flat metal workpiece;

swaging a selected portion of said workpiece to define a flange bent upright from the remaining portion of said workpiece, the flange bend extending substantially along a line, wherein prior to swaging said flange defining selected portion is integrally connected to said workpiece both along said bend line and along at least a portion of lateral sides of said workpiece selected portion.

6. The method of claim 5, wherein said workpiece selected portion is substantially rectangular with a top side and bottom side, said lateral sides extending between said top and bottom sides, said bottom side corresponding substantially to said bend line and portions of said lateral sides being integrally connected to the remaining portion of said workpiece.

7. The method of claim 6, wherein said swaging step causes non-elastic stretching of said workpiece to form supporting wings on said lateral sides of said selected portion.

8. The method of claim 6, wherein said swaging step also curves said flange adjacent said top side.

9. The method of claim 5, further comprising the step of forming securement means adapted for securing said remaining portion of said workpiece against a window frame or window sash.

10. A window snubber system for maintaining a window sash in proper orientation relative to a window frame when closed relative thereto, comprising:

a first snubber including:

a first flat metal base with securement means for securing said base against a window frame;

a first metal snubber flange integral with said first base and extending upright from said first base; and first supporting wings integrally formed with said first base and said first flange, said first wings extending from opposite sides of said first flange to integral connections to said first base; and a second snubber including:

a second flat metal base with securement means for securing said second base to a window sash;

a second metal snubber flange integral with said second base and extending upright from said second base; and second supporting wings integrally formed with said second base and said second flange, said second wings extending from opposite sides of said second flange to integral connections to said second base, wherein each of said flanges has a side adapted to engage a corresponding side on the other of said flanges when a window sash is closed relative to a window frame.

11. The snubber system of claim 10, whereby each of said flanges extends upright substantially along a plane with said engaging side facing one side relative to said plane, and each of said wing integral connections to said base extending on the other side relative to said plane.

12. The snubber system of claim 11, further comprising a portion on the top of each of said flanges bent into the other side relative to said plane.

13. The snubber system of claim 10, whereby engagement of the flanges with each other applies a compressive force to each of said supporting wings.

14. The snubber system of claim 10, wherein said first and second snubbers are substantially concealed from view when a sash is closed relative to the frame.

* * * * *